US009543716B2

(12) United States Patent
Bruno et al.

(10) Patent No.: US 9,543,716 B2
(45) Date of Patent: Jan. 10, 2017

(54) ELECTRICALLY COMPENSATED SMA SHELL CONNECTOR WITH CABLE DIELECTRIC CAPTIVATION

(71) Applicant: ENS Microwave, LLC, Brookfield, CT (US)

(72) Inventors: Saverio Bruno, Danbury, CT (US); Kristen Schretzenmayer, Danbury, CT (US)

(73) Assignee: ENS Microwave, LLC, Brookfield, CT (US)

( * ) Notice: Subject to any disclaimer, the term of this patent is extended or adjusted under 35 U.S.C. 154(b) by 0 days.

(21) Appl. No.: 14/878,447

(22) Filed: Oct. 8, 2015

(65) Prior Publication Data

US 2016/0218451 A1 Jul. 28, 2016

Related U.S. Application Data

(60) Provisional application No. 62/108,964, filed on Jan. 28, 2015.

(51) Int. Cl.

| | |
|---|---|
| ***H01R 9/05*** | (2006.01) |
| ***H01R 24/44*** | (2011.01) |
| *H01R 4/02* | (2006.01) |

(52) U.S. Cl.
CPC ..... *H01R 24/44* (2013.01); *H01R 4/023* (2013.01); *H01R 9/05* (2013.01)

(58) Field of Classification Search
CPC ..... H01R 4/023; H01R 9/05; H01R 24/38; H01R 24/40; H01R 24/42; H01R 24/44; H01R 24/56
USPC ..... 439/578, 98, 874, 875
See application file for complete search history.

(56) References Cited

U.S. PATENT DOCUMENTS

| | | | | |
|---|---|---|---|---|
| 4,431,255 | A * | 2/1984 | Banning | H01R 9/0521 439/578 |
| 4,486,726 | A * | 12/1984 | Schafer | H01P 1/045 174/88 C |
| 8,579,659 | B2 * | 11/2013 | Tran | H01R 13/625 439/578 |
| 8,622,768 | B2 * | 1/2014 | Van Swearingen | H01R 13/625 439/315 |
| 8,827,743 | B1 * | 9/2014 | Maury | H01R 24/40 439/578 |

* cited by examiner

*Primary Examiner* — Khiem Nguyen
(74) *Attorney, Agent, or Firm* — Ware, Fressola, Maguire & Barber, LLP

(57) ABSTRACT

The present invention relates to a microwave cable and connector. The microwave cable includes a cable center conductor, a cable dielectric surrounding the cable center conductor and a cable outer conductor surrounding the cable dielectric. A connector body is provided that surrounds the cable outer connector. The connector body has a reduced diameter portion extending beyond the edges of the cable dielectric and the cable outer conductor, and the reduced diameter portion further extends radially inwardly to create a step. The diameter across the step is less than the diameter of the cable dielectric, and the step at the end of the connector body is able to block movement of the cable dielectric. The connector body includes at least one soldering hole that extends through the connector body in a circular recess formed in the connector body dimensioned for receipt of a snap ring.

20 Claims, 5 Drawing Sheets

ELECTRICALLY COMPENSATED SMA SHELL CONNECTOR WITH CABLE DIELECTRIC CAPTIVATION

CROSS REFERENCE TO RELATED APPLICATIONS

The present application claims the benefit of U.S. Provisional Patent Application No. 62/108,964, filed Jan. 28, 2015, which is hereby incorporated by reference in its entirety.

FIELD OF THE INVENTION

The present invention relates to SubMiniature version A ("SMA") connectors.

BACKGROUND OF THE INVENTION

SubMiniature version A ("SMA") shell connectors are defined in military and trade specifications. Some of these connectors use the center conductor of the cable as the connector center contact, and the cable dielectric as the connector dielectric. Most coaxial connectors have separate contacts and dielectric inserts that hold the center conductor centrally within the connector. This connector is used primarily on a cable having an outer diameter of 0.141 inches and provides a low cost, very short microwave connector. Assemblies using this cable and connector combination generally are used to interconnect microwave modules mounted on printed circuit boards or microwave sub-assemblies.

An example of a standard, commercial shell-only SMA connector according to the prior art is shown in FIG. 1. A cable 10 is provided with a center conductor 14 surrounded by a dielectric 16. An outer conductor 12 surrounds the dielectric 16. The connector 20 is soldered on the outer conductor 12 of the cable 10 by applying solder 18 to the rear of the connector 20. The solder 18 then flows internally in the connector 20, between the connector 20 and the outer conductor 12, to complete an electrical path. The disadvantage of this construction is that a ring of solder is formed at the joint of the cable 10 and connector 20 at the rear of the connector 20. This limits where the cable 10 can be bent, thus preventing a tight bend at the rear of the connector 20 from being formed when necessary.

Another way to attach the connector to the cable is to solder the connector from the front of the cable at the connector interface. While this eliminates the solder build-up at the rear of the connector, solder instead builds up on the connector interface. The interface therefore must be machined by a separate operation during manufacture to eliminate the solder build up at the connector interface, where the male SMA connector would mate with a female SMA connector. This operation removes the gold plating on the connector interface and also tends to easily damage the center conductor of the cable, which projects outwardly.

A further, significant problem exists with either of these connector designs. After assembly, when the cable is twisted or bent, the cable dielectric can move forward and extend beyond the connector mating face (reference plane 60), and thus prevent proper mating with another connector.

The present invention addresses these shortcomings in in the prior art by eliminating the solder at the rear of the connector, eliminating the need to machine the interface, eliminating cable dielectric protrusion, and compensating for the interface capacitance caused by the mating of connectors with different inner and outer conductor diameters.

SUMMARY OF THE INVENTION

The present invention relates to a microwave cable and connector. According to a first aspect of the invention, the microwave cable includes a cable center conductor, a cable dielectric surrounding the cable center conductor and a cable outer conductor surrounding the cable dielectric. A connector body is provided that surrounds the cable outer connector. The connector body has a reduced diameter portion extending beyond the end edges of the cable dielectric and the cable outer conductor, and the reduced diameter portion further extends radially inwardly to create a step portion. The diameter across the step portion is less than a diameter of the cable dielectric, such that the step portion blocks movement of the cable dielectric out of the connector body.

According further to the microwave cable of the first aspect of the invention, in one embodiment, the connector body comprises at least one soldering hole positioned along the connector body and extending through the connector body. The one or more soldering holes are configured to receive solder for soldering the connector body to the cable outer conductor.

According further to the microwave cable according to the first aspect of the invention, in one embodiment, the connector body comprises a recessed portion around a circumference of the connector body. At least one soldering hole can be positioned within the recessed portion, which extends through the connector body, and is able to receive solder for soldering the connector body to the cable outer conductor.

According further to this embodiment of the first aspect of the invention, the microwave connector further includes a coupling nut secured to the connector body and configured to couple the microwave connector to a second microwave connector. A snap ring is placed in the recessed portion of the connector body and secures the connector body to the coupling nut. A sealing gasket is positioned around a circumference of the connector body and positioned in between the connector body and the coupling nut. In this embodiment, the microwave connector can mate a cable with the cable center conductor projecting beyond the cable dielectric to form a pin and the coupling nut is internally threaded. This male microwave connector is configured for connection with a corresponding female connector comprising a slotted contact to receive the pin and external threading to couple to the coupling nut.

According further to the microwave connector according to the first aspect of the invention, an air gap is formed within the step portion. The width of the air gap is calculated to compensate for the capacitive discontinuity caused by the mated pair of connectors, and can be approximately 0.008 inches. A high impedance zone is formed in the air gap having an impedance determined by the diameters or the mated connectors, for example, 66 ohms. A diameter of an interior section of the connector body configured to receive the cable center connector, cable dielectric and cable outer conductor is greater than the diameter across the step portion. For example, the diameter of the interior of the connector body can be approximately 0.143 inches and the diameter across the step portion is dimensioned to mechanically prevent the cable dielectric from protruding beyond the reference plane of the connector, and can be for example, approximately 0.110 inches.

According further to the microwave cable according to the first aspect of the invention, in one embodiment, the cable outer conductor comprises a layer of helical foil surrounded by a metallic braid.

According to a second aspect of the present invention, a connector is provided for use with a microwave cable. The connector comprises a connector body and a connector interior circumferentially surrounded by the connector body and configured to receive a microwave cable. The connector body further includes a circumferential recessed portion on the connector body comprising at least one soldering hole extending through the connector body. A step portion is provided at one end of the connector body. The step portion extends inwardly and the diameter across the step portion is less than the diameter of the connector interior.

According further to the second aspect of the invention, the step portion is configured to prevent a cable or a cable dielectric from protruding out said end of the connector body.

According further to the second aspect of the invention, the one or more soldering holes are configured to receive solder for soldering the connector to the cable.

According further to the second aspect of the invention, in one embodiment the circumferential recessed portion is configured to receive a snap ring for securing the connector to a coupling nut.

DETAILED DESCRIPTION OF THE DRAWINGS

The SMA-shell connector and microwave cable according to present invention will be described further with reference made to FIGS. 2-5.

Figure 1:
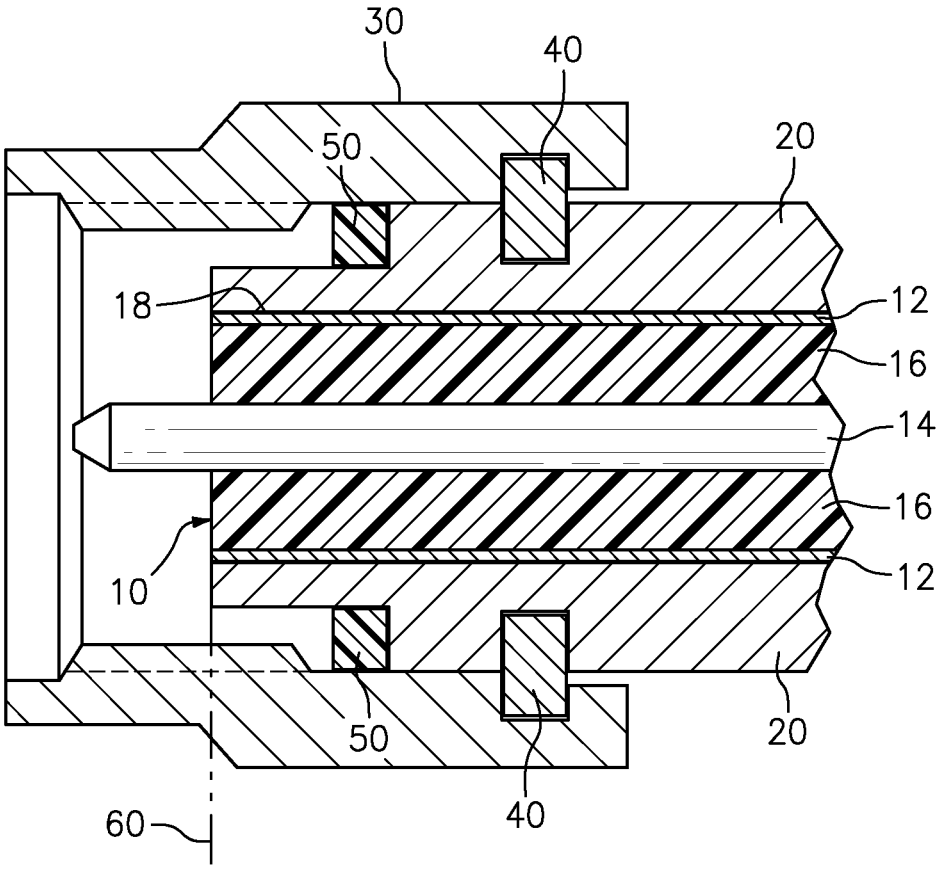
FIG. 1 (PRIOR ART)
FIG. 1 shows a cross sectional view of a standard, commercial, shell-only SMA connector according to the prior art.
Figure 2:
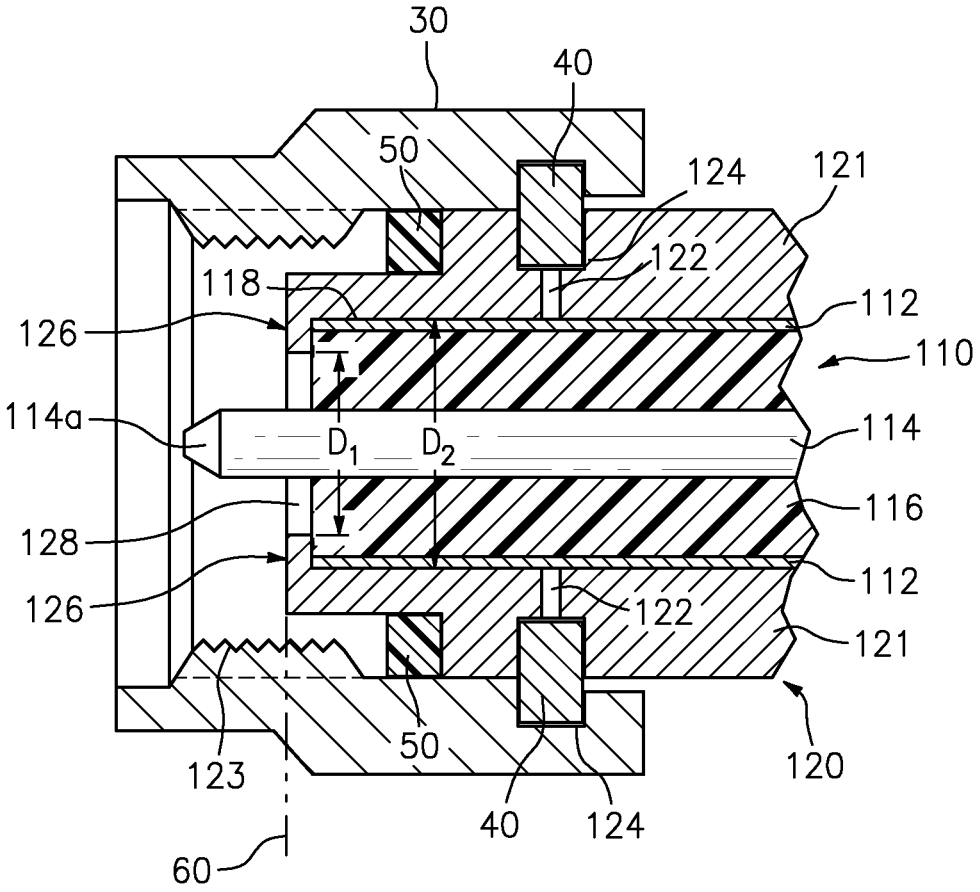
FIG. 2 shows a cross-sectional view of an embodiment of the cable and connector according the present invention.
Figure 3:
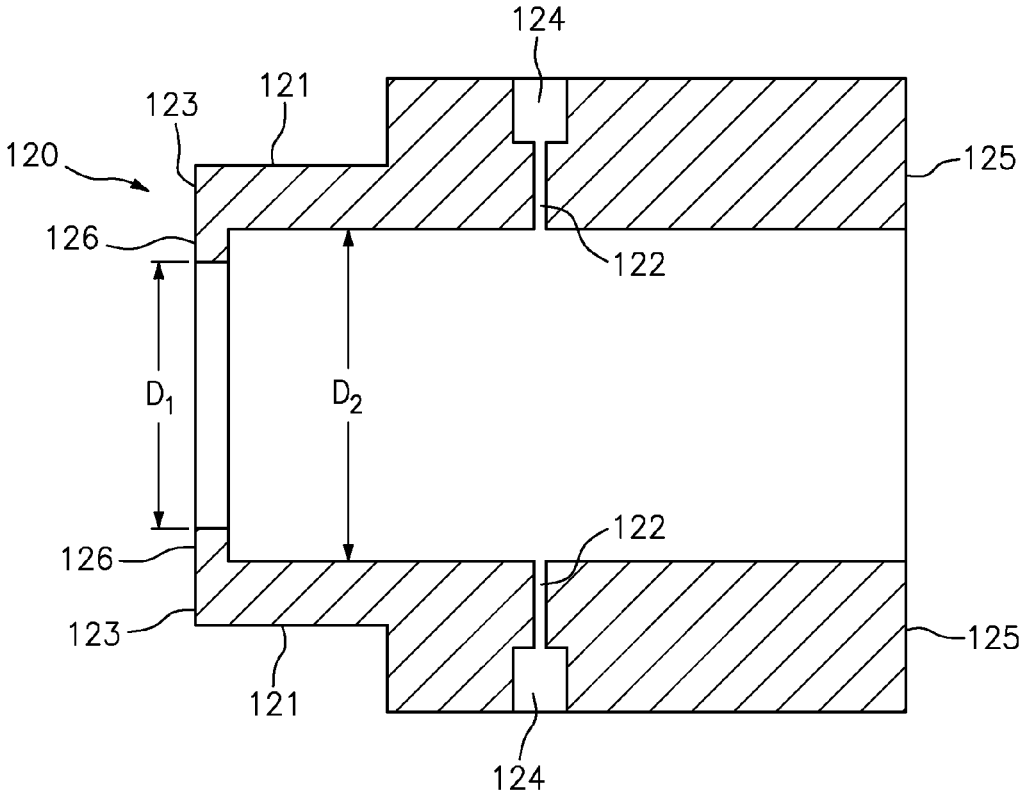
FIG. 3 shows a cross-sectional view of an embodiment of the connector according to the present invention

The present invention relates to a cable 110 and connector 120 preferably for use in microwave cable assemblies. A cross-sectional view of a preferred embodiment of the cable 110 and connector 120 according to the present invention is shown in FIG. 2. A cross-sectional view of the preferred embodiment of the connector 120, without the cable 110 inserted therein, is shown in FIG. 3.

The cable 110 according to the present invention includes a cable outer conductor 112 surrounding a cable dielectric 116. In a male-configured connector, such as the cable 110 shown in FIG. 2, a cable center conductor 114 is provided, which at the end of the cable 110 projects from the cable dielectric 116 to form a pin 114*a*. In a preferred embodiment, the cable 110 according to the present invention is a microwave cable.

Figure 4A:
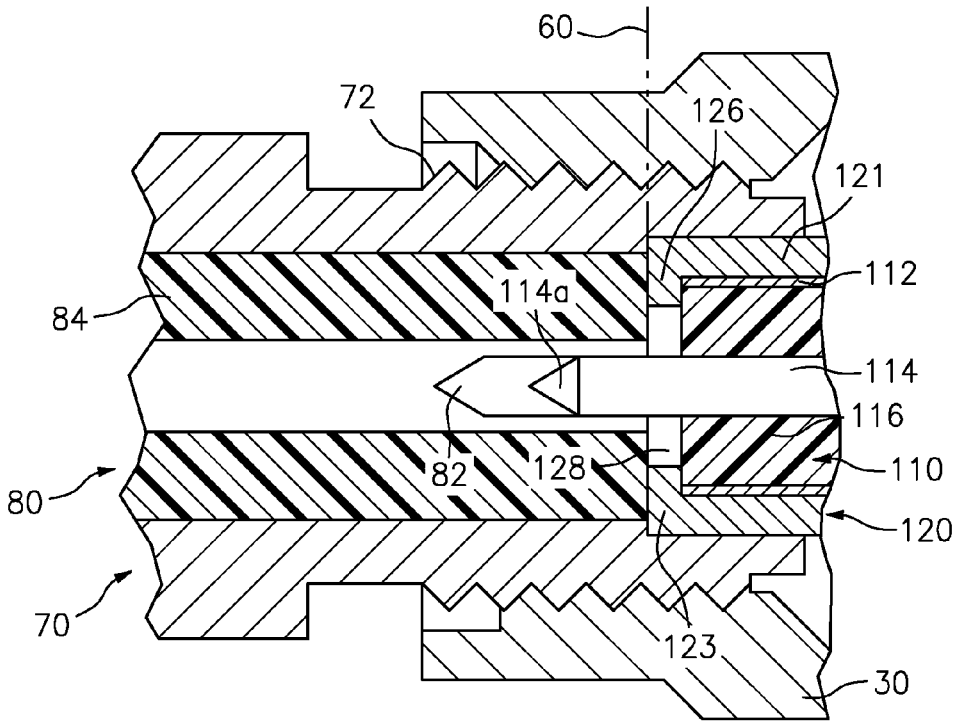
FIG. 4A shows a cross-sectional view of an embodiment of the cable and connector according to the invention mated with a second SMA connector.

The connector 120 has a body 121 surrounding the end of cable 110, including surrounding the cable outer conductor 112, the cable dielectric 116 and the cable center conductor 114. The cable center conductor 114 projects out past the cable dielectric 116 and the interface 123 of the connector body 120, forming a pin 114*a*. The pin 114*a* on the male cable 110 is received by a slotted contact 82 on a female connector 80 when the male cable 110 is connected to the female connector 80, as shown in FIG. 4A for example.

The connector body 121 includes a recess 124, which surrounds the circumference of the connector body 121 at a portion of the connector body 121. The recess 124 is dimensioned to receive a snap ring 40, which secures the connector 120 to a coupling nut 30. The coupling nut 30 couples the cable 110 and connector 120 to another cable and connector configured to receive and couple with the coupling nut 30. Within the recess 124, one or more solder holes 122 are provided. The solder holes 122 extend from the base of the recess 124 through the connector body 121, exposing through the recess 124 the interior of the connector 120, or the cable outer conductor 112 when the cable 110 is inserted into the connector 120. The number and location of the solder holes 122 can vary along the connector body 121, but in a preferred embodiment, two diametrically opposed solder holes 122 can be provided within the recess 124.

After the cable 110 has been inserted into the connector 120, a solder 118 is applied to the cable 110 and the connector 120 by feeding the solder 118 through solder holes 122 positioned underneath the recess 124. The solder 118 flows through the solder holes 122, filling in any space between the connector body 121 and the cable outer conductor 112. The solder holes 122 through which the solder 118 is added are substantially centrally located between the connector interface 123 and the rear 125 of the connector body 121, and no solder 118 is applied at the interface 123 or at the rear 125 of the connector body 121. As a result, there is not a build-up of solder 118 at either the connector interface 123 or at the rear 125 of the connector body 121 that must be removed by a separate process.

The connector body 121 has a reduced diameter $D_1$ relative to the diameter of the cable 110 and the interior of the connector 120 receiving the cable 110, at the connector interface 123, where the cable 110 would attach to the front of the connector 120. The connector body 121 extends past the edges of the cable dielectric 116 and the cable outer conductor 112, creating a gap 128 between the connector interface 123 of the connector body 121 and the edges and the ends of the cable dielectric 116 and the cable outer conductor 112. The connector body 121 extends inwardly at this gap 128, creating an inner diameter $D_1$ between the extension points 126, referred to as a step 126. The diameter $D_1$ within/across the step 126 is less than the inner diameter $D_2$ along the rest of the connector body 121.

This reduced diameter $D_1$ within the step 126 is also less than the diameter of the cable dielectric 116. As described previously, when a cable such as cable 110 is bent, the bending action can urge the cable dielectric 116 forward past the connector interface 123. The step 126 having a diameter $D_1$ less than the diameter of the cable dielectric 116 prevents the cable dielectric 116 from moving beyond the interface 123 of the connector 121, past a reference plane 60 because the cable dielectric 116 is wider than the opening at the end of the connector body 121 across the step 126. When the cable 110 is bent or twisted, the step 126 of the connector body 121 is configured to keep the cable dielectric 116 in position so that it cannot extend past the reference plane 60 and interfere with connections that will be made using the cable 110. If the cable dielectric 116 is urged forward by bending the cable 110, the outward movement of the cable dielectric 116 is blocked by the step 126.

Because the area where the cable 110 attaches to the front of the connector 120 has a slightly smaller diameter $D_1$ than would otherwise be present, and the cable dielectric 116 does not enter the space within the step 126, an air gap 128 is formed between the cable dielectric 116 and the connector interface 123 or reference plane 60. In an exemplary embodiment of the invention, the width of the gap 128, which is the distance from the edge of the cable dielectric 116 and the edge of the connector interface 123, is 0.008 inches. In a preferred embodiment, the diameter of the reduced area ($D_1$) is 0.110 inches, in contrast to the inner diameter $D_2$ of the connector body, which is 0.143 inches. With the preferred dimensions described herein, the width of the gap 128 of 0.008 inches and the diameter of the reduced area (0.110 inches reduced from 0.143 inches), a high impedance zone of 66 ohms is provided. The high impedance zone provides electrical compensation for the capacitance caused by mating two connectors with different outer and inner conductor diameters. Thus, there is not a reduction in the functionality of the cable 110 and connector 120 caused by the step 126 and resulting air gap 128.

A coupling nut 30 can surround the end of the cable 110 and the connector 120, as shown for example in FIG. 2. The coupling nut 30 is configured to couple the cable 110 and connector 120 to another cable and connector. Preferably, a sealing gasket 50 is also placed around the connector body 121, and is positioned between the connector body 121 and coupling nut 30. In a preferred embodiment, the coupling nut 30 includes a threaded interior, which surrounds the pin 114*a*. The threaded interior is configured to mate with a threaded exterior 72 on a corresponding connector 70 of a female connector 80.

Figure 4B:
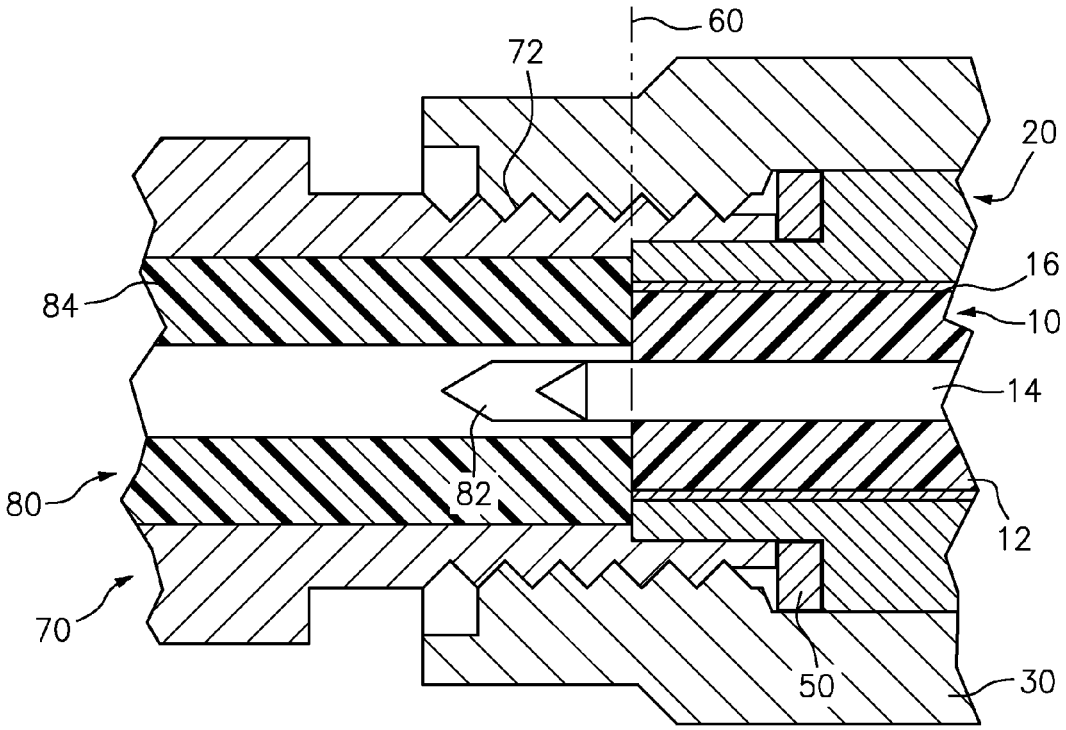
FIG. 4B (PRIOR ART)
FIG. 4B shows a cross-sectional view of an embodiment of the cable and connector according to the prior art mated with a second SMA connector.

To further illustrate attributes of the present invention, FIG. 4A shows an exemplary embodiment of the cable and connector according to the present invention, adjacent to FIG. 4B, which shows an example of a standard male connector known in the art, each in combination with a properly mated SMA female connector 70 and cable 80. According to the present invention, when male and female cables/connectors are connected, the connector dielectric 84 of the female connector 80 contacts the connector interface 123 along the reference plane 60, but the air gap 128 is provided which separates the connector dielectric 84 of the female connector 80 from the cable dielectric 116 of the male cable 110. Using the connector 20 of the prior art with the female connector 80, the cable dielectric 84 of the female connector 80 contacts the connector interface of connector 20 and the cable dielectric 16 along the reference plane 60. If the cable 10 is bent and the cable dielectric 16 projects outwardly beyond the reference plane 60 and the connector 20, the connector 20 would no longer allow contact with the both the female center contact 82, and the outer conductor 84 of the female connector 80 along the reference plane 60, and the connected cables would not function properly.

Figure 5A:
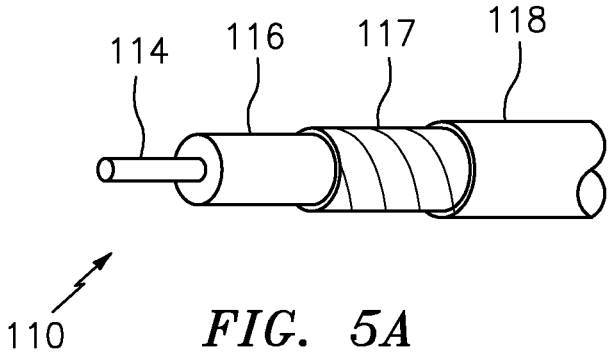
FIGS. 5A, 5B and 5C show expanded views of various types of cables that can be used with the connector according to the invention.
Figure 5B:
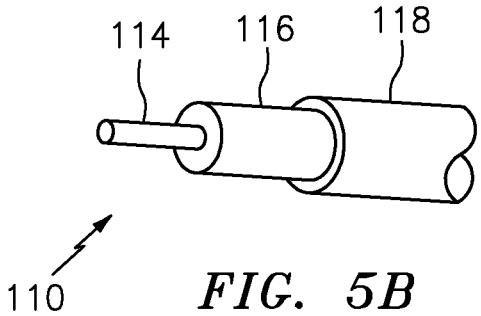
Figure 5C:
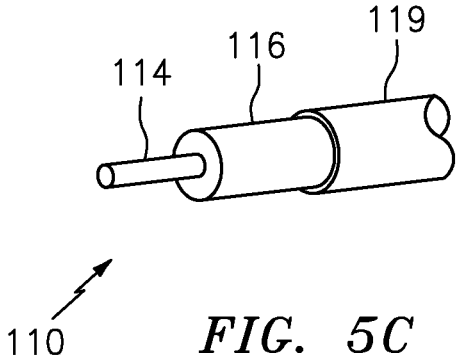

FIGS. 5A, 5B and 5C show various types of cables 110 that can be used with this invention. In an exemplary embodiment, the cable 110 shown in FIG. 5A is used primarily by this invention. The nominal cable dimensions for this type of cable 110 according to a preferred embodiment of the invention are:

Outer diameter of the cable 110: 0.141 inches
Diameter of the cable dielectric 116: 0.116 inches
Diameter of the center conductor 114: 0.036 inches However, the present invention is not limited to any particular dimensions of the cable 110, but could also be used with cables other than an outer diameter of 0.141 inches if needed.

The cable 110, as shown in FIG. 5A, comprises a cable center conductor 114 surrounded by a cable dielectric 116. A layer of helical foil 117 is provided around the cable dielectric 116, which is surrounded by a metal braid 118. The helical foil 117 and metal braid 118 serve as the cable outer conductor 112 in this embodiment of the cable 110.

The cable 110, as shown in FIG. 5B, comprises a cable center conductor 114 surrounded by a cable dielectric 116. A metal braid 118 surrounds the cable dielectric 116. The metal braid 118 serves as the cable outer conductor 112 in this embodiment of the cable 110.

The cable 110, as shown in FIG. 5C, comprises a cable center conductor 114 surrounded by a cable dielectric 116. A copper tube 119 surrounds the cable dielectric 116. The copper or other metallic tube 119 serves as the cable outer conductor 112 in this embodiment of the cable 110.

It is noted that the cable center conductor 114, cable dielectric 116 and metal braid 118 are made from materials that would be used by a person of ordinary skill in the art in constructing a microwave cable.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention.

What is claimed:

1. A microwave cable comprising:

a cable center connector;

a cable dielectric surrounding the cable center connector;

a cable outer conductor surrounding the cable dielectric; and a connector body surrounding a portion of the cable outer conductor comprising a step portion extending inwardly and beyond the cable dielectric and the cable outer conductor, wherein a diameter across the step portion is less than a diameter of the cable dielectric, and the step portion block movement of the cable dielectric out of the connector body.

2. The microwave cable according to claim 1, wherein the connector body comprises at least one soldering hole positioned along the connector body and extending through the connector body.

3. The microwave cable according to claim 2, wherein the at least one soldering hole is configured to receive solder for soldering the connector body to the cable outer conductor.

4. The microwave cable according to claim 1, wherein the connector body comprises a recessed portion around a circumference of the connector body.

5. The microwave cable according to claim 4, wherein the connector body comprises at least one soldering hole positioned within the recessed portion and extending through the connector body, configured to receive solder for soldering the connector body to the cable outer conductor.

6. The microwave cable according to claim 4, further comprising a coupling nut secured to the connector body and configured to couple the microwave cable to a second microwave cable.

7. The microwave cable according to claim 6, further comprising a snap ring placed in the recessed portion of the connector body and configured to secure the connector body to the coupling nut.

8. The microwave cable according to claim 7, further comprising a sealing gasket positioned around a circumference of the connector body and positioned in between the connector body and the coupling nut.

9. The microwave cable according to claim 8, wherein the microwave cable is a male cable with the cable center conductor projecting beyond the cable dielectric to form a pin and the coupling nut is threaded internally, so that the microwave cable is configured for connection with a corresponding female connector comprising a slotted contact to receive the pin and external threading to couple to the coupling nut.

10. The microwave cable according to claim 1, wherein an air gap is formed within the step portion and having a width that is calculated to compensate for capacitive discontinuity caused by a mating the microwave cable to a second connector.

11. The microwave cable according to claim 10, wherein the width of the air gap is approximately 0.008 inches.

12. The microwave cable according to claim 11, wherein a high impedance zone is formed in the air gap having an impedance determined by diameters of the mated microwave cable and connector.

13. The microwave cable according to claim 12, wherein a diameter of an interior of the connector body configured to receive the cable center connector, cable dielectric and cable outer conductor is greater than the diameter across the step portion.

14. The microwave cable according to claim 13, wherein the diameter across the step portion is dimensioned to mechanically prevent the cable dielectric from protruding beyond a reference plane along an edge of the connector body.

15. The microwave cable according to claim 14, wherein the air gap has an impedance of approximately 66 ohms, the diameter of the interior of the connector body is approximately 0.143 inches and the diameter across the step portion is approximately 0.110 inches.

16. The microwave cable according to claim 1, wherein the cable outer conductor comprises a layer of helical foil surrounded by a metallic braid.

17. A connector for use with a microwave cable comprising:

a connector body, a connector interior circumferentially surrounded by the connector body and configured to receive a microwave cable, a circumferential recessed portion on the connector body comprising at least one soldering hole extending through the connector body, and a step portion at an end of the connector body extending inwardly, wherein a diameter across the step portion is less than a diameter of the connector interior.

18. The connector according to claim 17, wherein the step portion is configured to prevent a cable or a cable dielectric from protruding out said end of the connector body.

19. The connector according to claim 17, wherein the at least one soldering hole is configured to receive solder for soldering the connector to the cable.

20. The connector according to claim 17, wherein the circumferential recessed portion is configured to receive a snap ring for securing the connector to a coupling nut.

* * * * *